United States Patent [19]

Bridgwater

[11] Patent Number: 4,892,087

[45] Date of Patent: Jan. 9, 1990

[54] HEAT SHIELDING OF HOT FIREPLACES

[75] Inventor: Jon Bridgwater, Diamond Bar, Calif.

[73] Assignee: R. H. Peterson Co., City of Industry, Calif.

[21] Appl. No.: 346,878

[22] Filed: May 4, 1989

[51] Int. Cl.[4] ..... F24C 3/00

[52] U.S. Cl. ..... 126/512; 126/92 R; 126/42; 137/375; 169/48

[58] Field of Search ..... 126/512, 513, 544, 548, 126/552, 553, 83, 80, 92 R, 92 AC, 92 B, 91 R, 85 R; 431/125; 169/48; 165/135, 136; 237/79; 137/375

[56] References Cited

U.S. PATENT DOCUMENTS

| | | | |
|---|---|---|---|
| 316,967 | 5/1885 | Heber | 48/193 |
| 441,141 | 11/1890 | Dalton | 137/312 |
| 1,574,002 | 2/1926 | Rolland | 126/42 |
| 2,078,606 | 4/1937 | Le Grand | 137/375 |
| 2,600,616 | 6/1952 | Cartter | 126/512 |
| 3,589,971 | 6/1971 | Reed | 137/377 |
| 3,817,686 | 6/1974 | Quittner | 431/125 |
| 3,877,525 | 4/1975 | Husson et al. | 169/48 |
| 4,046,406 | 9/1977 | Press et al. | 285/47 |
| 4,307,813 | 12/1981 | Palmer | 220/4 R |
| 4,413,683 | 11/1983 | Hune | 169/48 |
| 4,605,232 | 8/1986 | Hundstad | 236/79 |
| 4,609,067 | 9/1986 | Gonwa | 126/83 |

*Primary Examiner*—James C. Yeung
*Attorney, Agent, or Firm*—William W. Haefliger

[57] ABSTRACT

A hot fireplace includes an elongated main gas burner associated with a grate for supporting logs, there being a control operatively connected with the burner to control flow of combustible gas to the burner, the control located near the fireplace. In this environment there is a heat shield located proximate the control to intercept infra-red radiation toward said control, the shield having perforations sized for intercepting such radiation, and for passing convection air therethrough. Typically, the perforations have cross dimensions less than the wavelength of infra-red radiation.

17 Claims, 1 Drawing Sheet

HEAT SHIELDING OF HOT FIREPLACES

BACKGROUND OF THE INVENTION

This invention relates generally to gas fireplace controls, and more particularly to shielding of such controls from heat radiated from the fireplace.

The controls for delivery of combustible gas to fireplace burners are commonly placed quite near the burners, as for example ½–4 feet away from the burners. This results in excessive heating of the controls—i.e. valves, etc.,—as by infra-red radiation from flames and hot artificial logs, at the fireplace grate area. Aside from possible danger of gas ignition at the controls, the latter become so hot that the user finds it difficult if not impossible to manipulate the controls. While heat shielding of the controls has been employed, excessive heating of the metal shield itself by radiated heat then becomes a problem, in the re-radiation to the controls, heating them excessively. There is need for improved metal shielding of such controls that keep the controls cool; also concealment of the controls is desirable, for safety.

SUMMARY OF THE INVENTION

It is a major object of the invention to provide a simple, effective solution to the above problem. Basically, the invention, which results in a solution for the problem, embodies a heat shield means located proximate the gas control (for example ON-OFF control) to intercept heat radiation toward that control, the shield means typically being metallic and having perforations sized for intercepting infra red radiation, while allowing convection air to flow through the perforations for cooling the shield means. The invention is of special advantage when the controls proximate the hot fireplace include a radio receiver for receiving RF signals from a hand-held controller, such signals serving to control ON-OFF operation of the gas delivery valve.

As will be seen, the perforations in the shield or shield means typically have cross dimensions less than the wavelength of infra-red radiation. Further, the shield means may advantageously include first and second metallic walls which are interposed between the hot fireplace and said control, the wall closest to the fireplace being substantially imperforate, and the wall closest to the control having said perforations.

More specifically, the heat shield means typically includes structure having top and side walls defining the perforations, the top wall extending over the control, and a first side wall interposed between the control and the hot fireplace. In this regard, the side walls typically include front and rear walls associated with the top and first side walls, the front and rear walls also defining perforations.

These and other objects and advantages of the invention, as well as the details of an illustrative embodiment, will be more fully understood from the following specification and drawings, in which:

DRAWING DESCRIPTION

DETAILED DESCRIPTION

Figure 1:
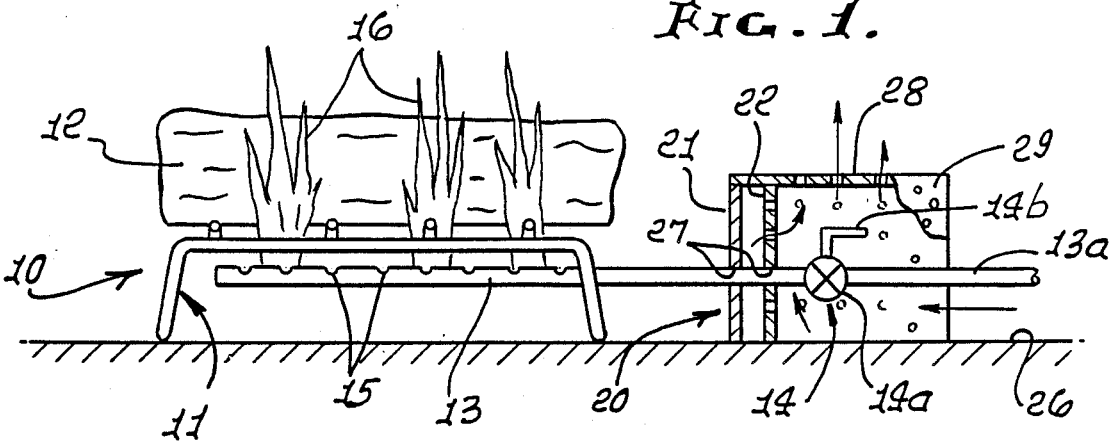
FIG. 1 is a frontal elevation showing a hot fireplace, and associated heat shielding for gas delivery control means.
Figure 2:
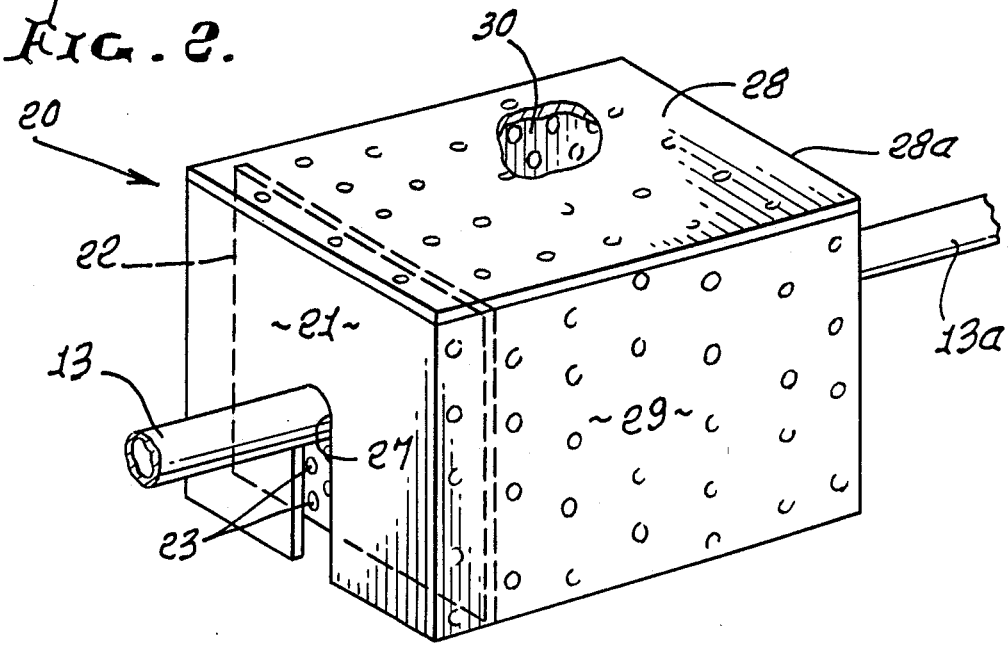
FIG. 2 is a perspective view showing a perforated heat shield structure that is convectively cooled.

Referring to FIG. 1, a fireplace 10 includes a grate 11, artificial logs 12 on the grate, and a gas burner 13 extending beneath the grate. Combustible gas delivered to the grate from the ON-OFF control 14, escapes from the burner via openings 15, to produce flames 16 rising between and over the logs. One or more of the logs may be natural, to combust and produce heat; and it is desired to operate the control 14 to initiate or stop gas delivery to the burner, at different times.

Normally, the control 14 is 1¼ to 4 feet from the hot fireplace, including the logs, which radiate heat outwardly toward a room and also toward the control, whereby shielding of the control is desirable. As shown in FIG. 1, the control includes a valve **14*a* (in line 13*a* leading to burner 13), and a valve control handle 14*b***, these normally being metallic.

In accordance with the invention, heat shield means 20 is provided proximate the control 14 to intercept infra-red (heat) radiation toward the control. In order to limit heating of the shield means, the latter is provided with perforations sized to intercept such radiation, while at the same time passing convection air rising at, through and around the heat shield means to cool it. The through perforations are between 1/32 and ¼ inches in diameter or cross dimension, to assure such functioning. Thus, such cross dimensions are less than the minimum wave length of the bulk of the wavelengths of infra-red radiation.

The particular shield means shown is of unusual advantage, in this regard. It comprises a hollow, thin-walled, box-like structure 20 having first and second upright, thin, substantially parallel, metallic walls or baffles 21 and 22 (for example of steel sheet) which are interposed in line between the hot fireplace and the control 14. The wall 21 closest to and facing the fireplace is imperforate or substantially so, and the wall 22 closest to and facing the control 14 contains a multitude of spaced, through perforations 23 having cross dimensions between ⅛ and ⅜ as referred to above. Both walls are in line between the hot fireplace and the control. Wall 21 heats up due to direct intercepting of infra-red radiation, but secondary radiation from wall 21 toward the control is intercepted by the perforated wall 22. Convection air flows upwardly in the space 24 between such walls, as well as through the perforations in wall 22 and adjacent opposite sides of wall 22 to cool same. Therefore the level of heat radiation from wall 22 to the control is quite low, and the temperature at the surface of the control can be kept less than 120° F., despite temperature at the fireplace in excess of 250° F.

Walls 21 and 22 are upright and extend at the level of the control and at least about 2 inches above the top level of the control. Walls 21 and 22 may extend to floor level 26, and define openings 27 to pass the pipe **13*a*** leading to the burner.

The heat shield means may be in the form of a shell, and include horizontal top wall 28 extending over the control 14, and front and rear upright walls 29 and 30 normal to walls 21 and 22. Walls 29 and 30 are attached to walls 21 and 22, as well as to wall 28. The side of the shield means farthest from the walls 21 and 22 is typically left open, for cool convection air entry to pass through the perforations in walls 22, 28, 29 and 30, for cooling such walls.

The box-like shield means may be lifted as by grasping top wall 28 at edge **28*a* remote from wall 22, to gain access to the control 14**, for manual manipulation of same (ON-OFF control). The shield means may then be replaced downwardly over the control to conceal same and keep it relatively cool.

Figure 3:
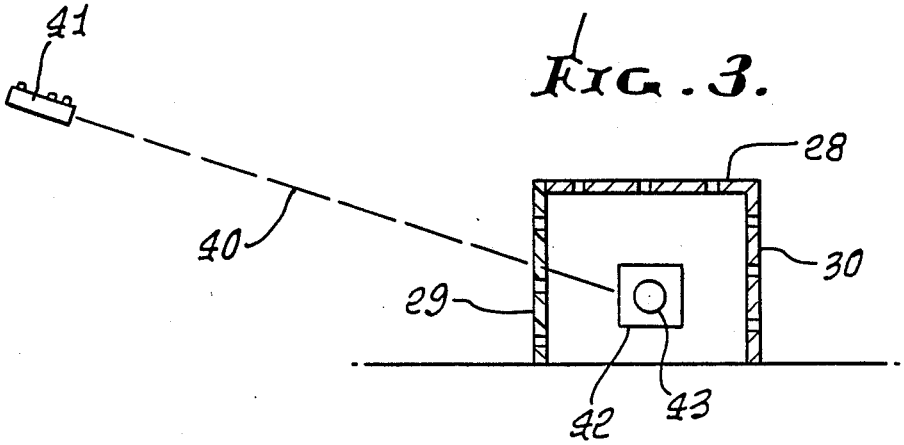
FIG. 3 is a diagrammatic view.

As seen in FIG. 3, front wall 29 may be nonmetallic, as for example of particle board, or plastic, to pass radio waves or acoustic waves 40 from a hand-held controller 41 to a receiver 42 at the controls 14. The receiver operates an actuator 43 which in turn operates the controls (ON-OFF, and gas ignition).

I claim:

1. For combination with a hot fireplace that includes an elongated main gas burner associated with a grate for supporting logs, there being a control operatively connected with the burner to control flow of combustible gas to the burner, the control located near the fireplace, (a) heat shield means located proximate the control to intercept infra-red radiation toward said control, (b) said shield means having perforations sized for intercepting such radiation, and for passing convection air therethrough.

2. The invention of claim 1 wherein said perforations have cross dimensions less than the wavelength of infra-red radiation.

3. The invention of claim 1 wherein said shield means includes first and second metallic walls which are interposed between the hot fireplace and said control, the wall closest to the fireplace being substantially imperforate, and the wall closest to the control having said perforations.

4. The invention of claim 1 wherein said heat shield means includes structure having top and side walls defining air passing perforations, the top wall extending over said control, and including a radiation intercepting upright wall interposed between said control and the hot fireplace.

5. The invention of claim 4 wherein said structure side walls include front and rear walls associated with said top and upright walls, said front and rear walls also defining perforations.

6. The invention of claim 1 wherein said control is a gas valve.

7. The invention of claim 1 including an actuator for operating the control, and a receiver connected with the actuator for receiving radio or acoustic waves that serve to control the actuator.

8. The combination of claim 7 wherein the shield means includes a shell having a front wall which is non metallic to pass said waves.

9. In combination with a hot fireplace that includes an elongated main gas burner associated with a grate for supporting logs, there being a control operatively connected with the burner to control flow of combustible gas to the burner, the control located near the fireplace, (a) heat shield means located proximate the control to intercept heat radiation toward said control, (b) said shield means having perforations sized for intercepting such radiation, and for passing convection air therethrough.

10. The combination of claim 9 wherein said perforations have cross dimensions less than the wavelength of infra-red radiation.

11. The combination of claim 9 wherein the shield means includes first and second metallic walls which are interposed between the hot fireplace and said control, the wall closest to the fireplace being substantially imperforate, and the wall closest to the control having said perforations.

12. The combination of claim 9 wherein said heat shield means includes structure having side walls defining air passing perforations, the top wall extending over said control, and including a radiation intercepting upright wall interposed between said control and the hot fireplace.

13. The combination of claim 12 wherein said structure side walls include front and rear walls associated with said top and upright walls, said front and rear walls also defining perforations.

14. The invention of claim 15 wherein the control is a gas valve.

15. For combination with a hot fireplace that includes an elongated main gas burner associated with a grate for supporting logs, there being a control operatively connected with the burner to control flow of combustible gas to the burner, the control located near the fireplace (a) heat shield means located proximate the control to intercept heat radiation toward said control, (b) said shield means defining perforation to pass convection air, and constructed to intercept heat radiation, (c) said shield means including first and second metallic walls which are interposed between the hot fireplace and said control, the wall closest to the fireplace being substantially imperforate, and the wall closest to the control having said perforation.

16. The invention of claim 15 wherein said heat shield means includes metallic structure that includes a top wall and a side wall which define air passing perforations.

17. The invention of claim 11 wherein the control is a gas valve.

* * * * *